United States Patent [19]

Haggerty et al.

[11] Patent Number: 4,901,841

[45] Date of Patent: Feb. 20, 1990

[54] PARTS SORTER

[75] Inventors: Matthew K. Haggerty, Medford, Mass.; David G. Jansson, Bryan, Tex. Christopher T. Zirps, Charlestown, MA

[73] Assignee: Kirby Lester, Inc., Stamford, Conn.

[21] Appl. No.: 37,608

[22] Filed: Apr. 13, 1987

[51] Int. Cl.[4] ..... B65G 37/00

[52] U.S. Cl. ..... 198/358; 198/445; 209/920

[58] Field of Search ..... 198/358, 444, 445, 446, 198/836; 209/539, 920, 921

[56] References Cited

U.S. PATENT DOCUMENTS

| | | | |
|---|---|---|---|
| 3,095,960 | 7/1963 | Luginbuhl | 198/444 |
| 3,355,003 | 11/1967 | Wayne et al. | 198/461 |
| 3,444,980 | 5/1969 | Wiseman | 198/445 |
| 3,730,386 | 5/1973 | Monsees | 198/444 X |
| 3,767,027 | 10/1973 | Pund et al. | 198/453 X |
| 4,029,195 | 6/1977 | Hartness et al. | 198/445 X |
| 4,129,207 | 12/1978 | Cupp | 198/445 |

FOREIGN PATENT DOCUMENTS

| | | |
|---|---|---|
| 565275 | 11/1944 | United Kingdom . |
| 584227 | 1/1947 | United Kingdom . |
| 617693 | 2/1949 | United Kingdom . |
| 671821 | 5/1952 | United Kingdom . |
| 761553 | 11/1956 | United Kingdom . |
| 838230 | 6/1960 | United Kingdom . |
| 931124 | 7/1963 | United Kingdom . |
| 1013533 | 12/1965 | United Kingdom . |
| 1079174 | 8/1967 | United Kingdom . |
| 1093800 | 12/1967 | United Kingdom . |
| 1290961 | 9/1972 | United Kingdom . |
| 1318988 | 5/1973 | United Kingdom . |

*Primary Examiner*—Robert J. Spar
*Assistant Examiner*—Cheryl L. Gastineau
*Attorney, Agent, or Firm*—David P. Gordon

[57] ABSTRACT

An apparatus for sorting a plurality of parts includes: a holding bin having an opening for releasing some parts; a vibrator for imparting forward translation to the parts; a channel having a width of approximately nx, where n is an integer greater than one and x is the width of a characteristic dimension of the parts based on a preferred translation orientation; and a descending fluted chute having substantially n rounded flutes, each of a width of at least x. The channel accepts the parts from the opening in the holding bin, and due to the vibrator arranges the parts into a substantially single plane parts or no more than n abreast in the channel. The fluted chute guarantees that any parts till stacked are separted. The parts sorter is preferably adjustable for handling parts of different dimensions, and therefore the fluted chute has diverging flutes which are separated by adjustable fingers so that the width of the end of the channel and the width of the portion of the fluted chute which first receives the parts are substantially equal. Automatic adjustment is provided by including optical sensors which are sensitive to the dimensions of the parts and feedback from the sensors to a servo system controlling fingers defining the flutes of the chute.

22 Claims, 9 Drawing Sheets

FIG. 4A1
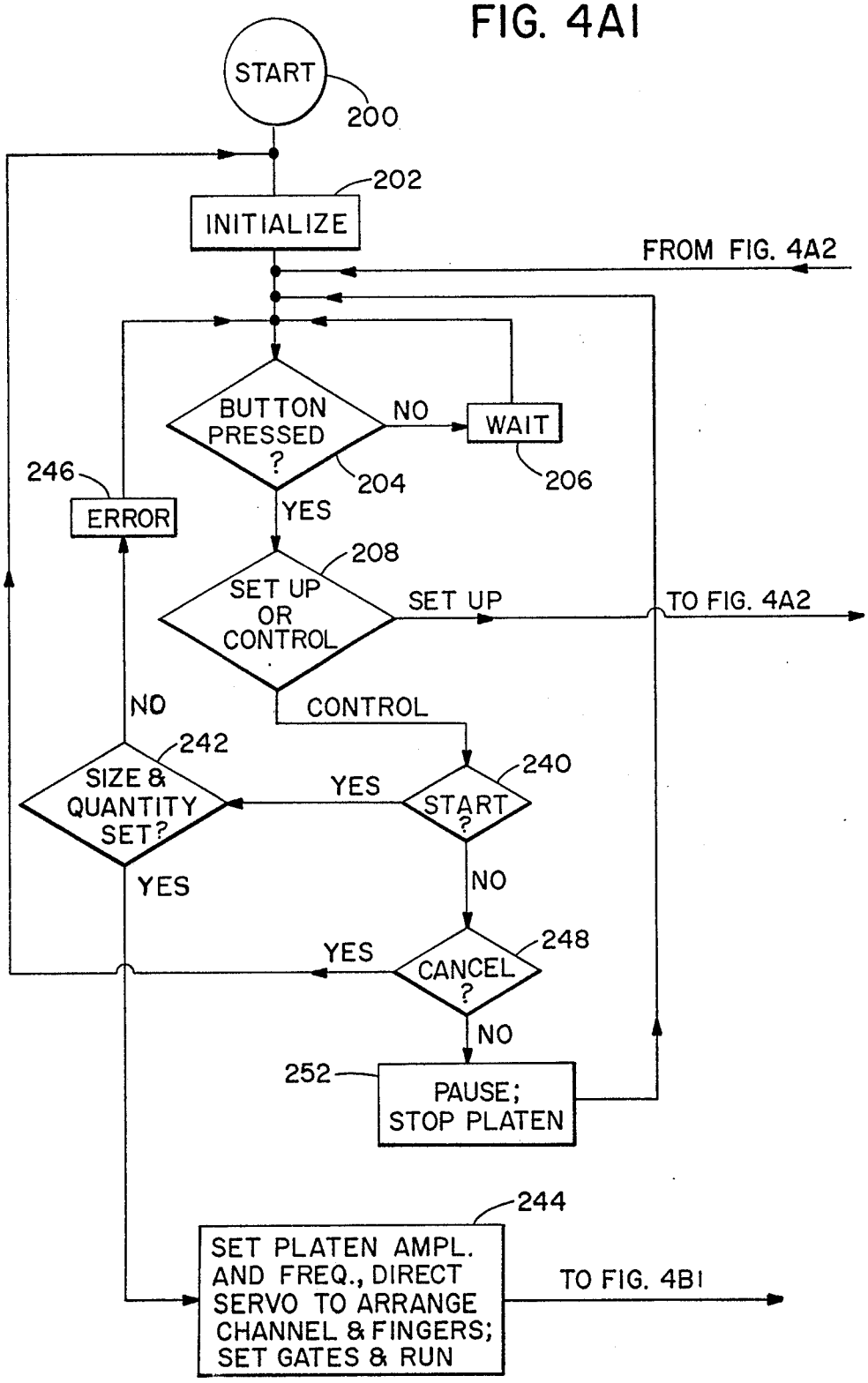

FIG. 4A2
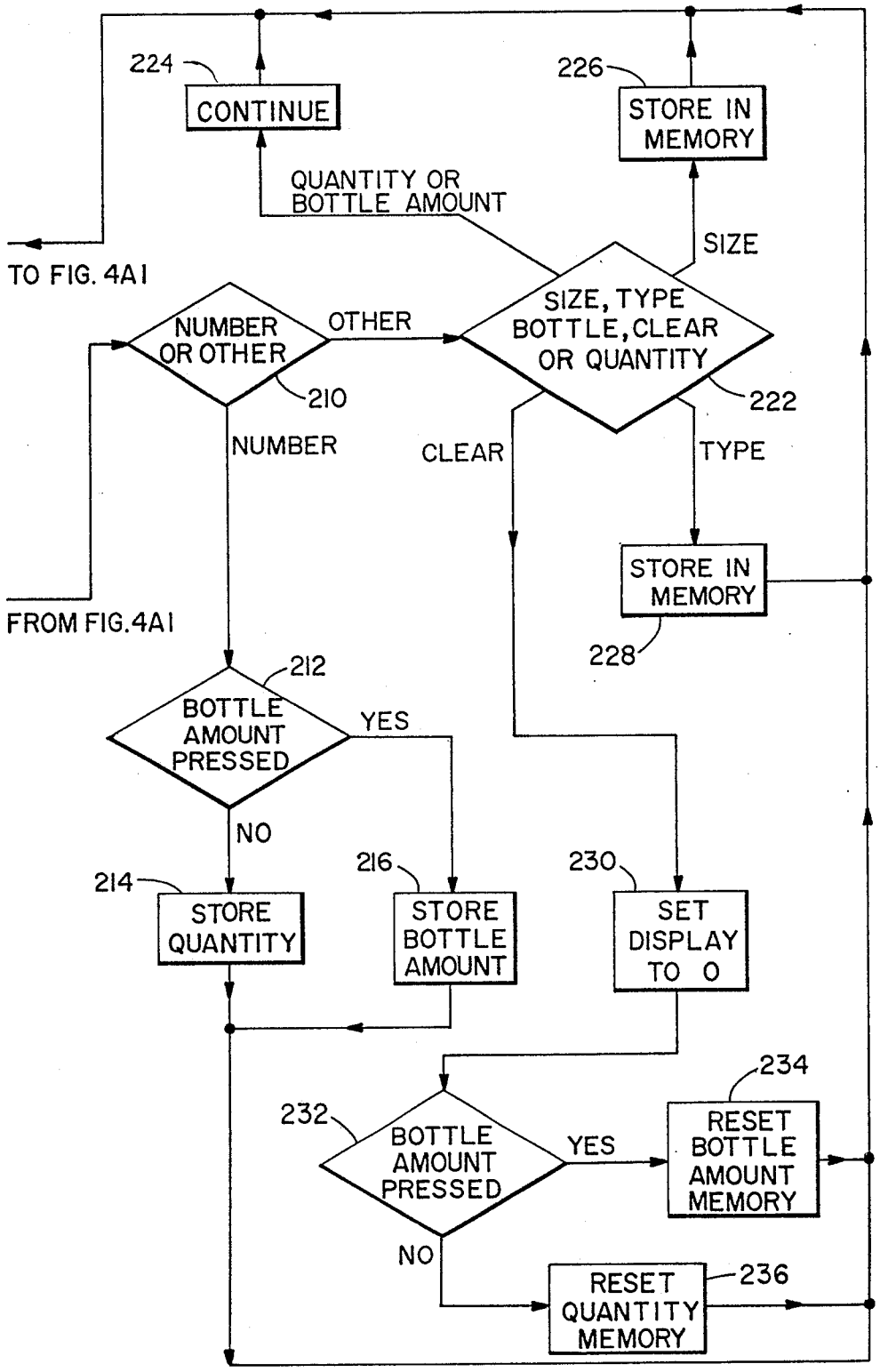

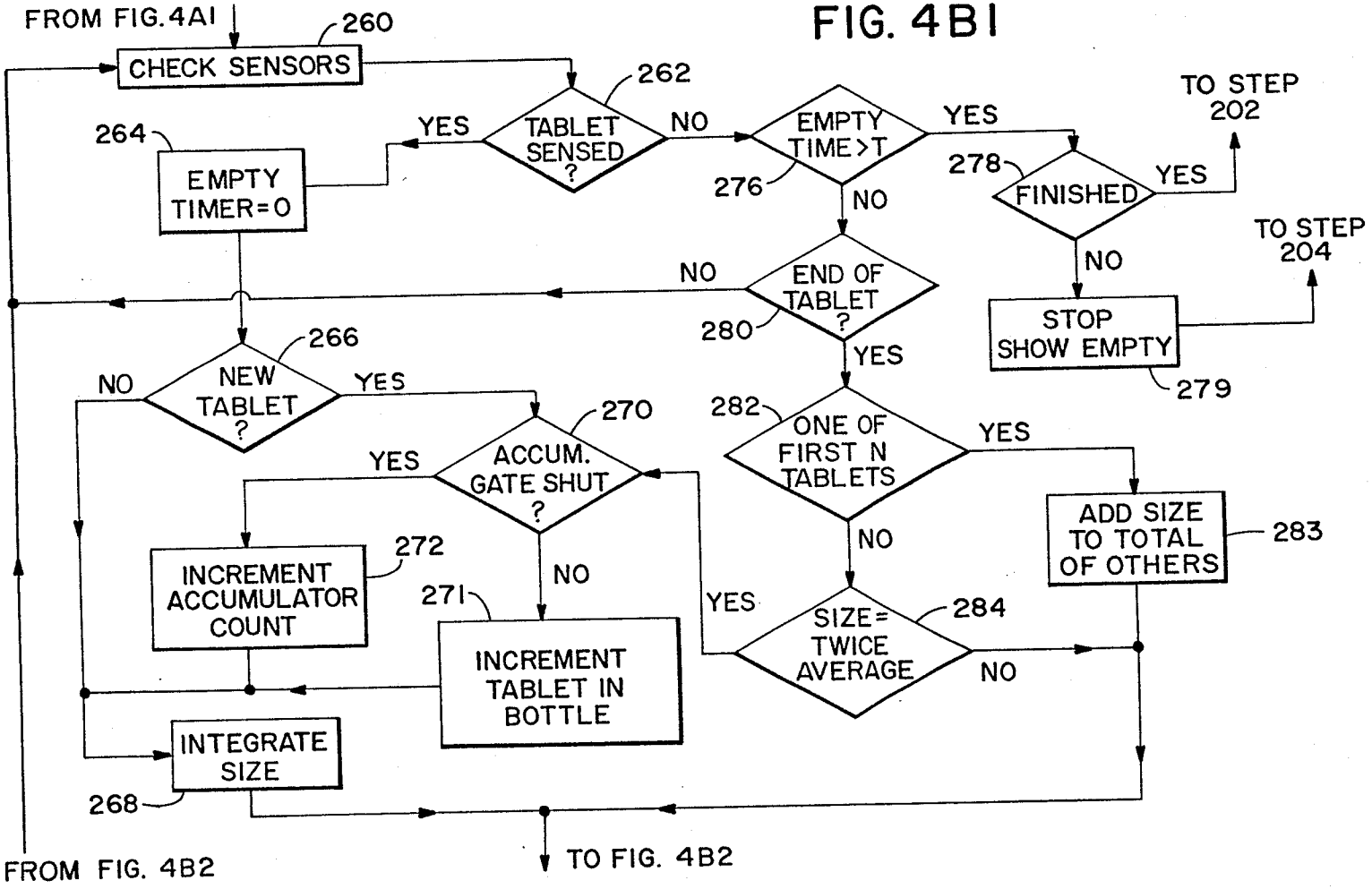
FIG. 4B1

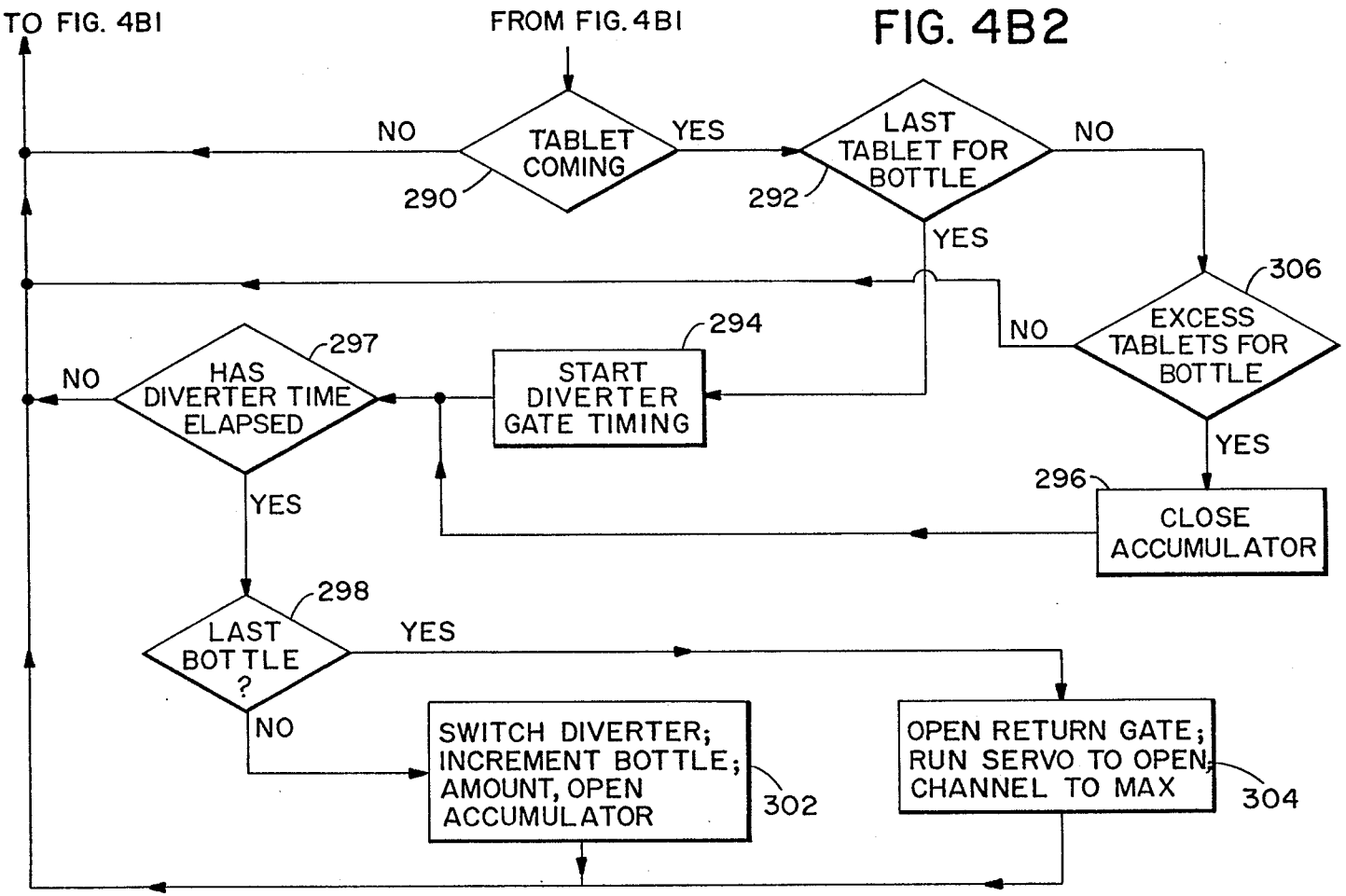
FIG. 4B2

PARTS SORTER

BACKGROUND

The invention generally relates to a parts sorter, and more particularly to an optical tablet and capsule counter for use in the pharmaceutical industry.

Optical counters for counting tablets and/or capsules have been known in the pharmaceutical industry for some time. Such counters take various forms. It is generally the common goal of such counters to reduce a pile of tablets or capsules to a single one-dimensional row so that they may be counted as they move past an optical sensor. Some of the various systems for accomplishing the same include rotational and linear vibrators, rotating discs, air jets, gravity feeds, moving belts, etc. Each system has its benefits and drawbacks.

Among the difficulties encountered by optical tablet or capsule counter systems are the requirements of: having a high throughput and accuracy; allowing different size tablets and capsules to be accommodated without undergoing extensive or difficult adjustments in the machine; providing an automatic feed and collection of tablets and capsules in excess of a selected or desired quantity; and providing for the tablets and capsules to be deposited directly into a final container, all with the goal of providing a relatively small sized, reliable counter. In the past, in order to obtain some of the goals, various other goals have been ignored or highly compromised. Typically, high count rate and highly accurate machines have been large in size, while smaller machines have been less accurate or have suffered from low throughput. Moreover, the art has not provided any small, high count rate, accurate machines capable of accommodating various tablet and capsule sizes without difficult machine adjustments.

SUMMARY OF THE INVENTION

It is therefore an object of the invention to provide a high throughput parts counter which is small in size, accurate, and simple to use;

It is another object of the invention to provide a parts detector which is capable of counting parts of various sizes without difficult adjustment;

It is a further object of the invention to provide an optical parts counter for pharmaceuticals, capable of counting tablets and capsules of various sizes with automatic adjustment to accommodate the same;

It is yet a further object of the invention to provide an automatically size-adjustable optical tablet and capsule counter of small size, high throughput, and high accuracy.

In accord with the objects of the invention, the parts sorter of the invention broadly comprises:

(a) a holding bin having a holding area for holding a plurality of substantially identical parts and an opening for releasing some of said parts;

(b) a means of forward translation of the parts;

(c) a channel having a width of approximately nx, where n is an integer greater than one and x is the width of a characteristic dimension of said parts based on a preferred orientation of the parts due to translation, where said channel accepts a plurality of parts from said opening in said holding bin, and together with said means for forward translation arranges the parts into a single plane of parts of no more than n abreast in said channel and forwards the parts towards a chute; and (d) a fluted chute having n flutes each of a width of at least x, for dividing said single plane of parts into n one dimensional lines of parts, such that said parts may be individually handled. Where the parts sorter includes an optical counter, the sorter preferably further includes an optical sensor for counting the parts travelling in or exiting each flute of said fluted chute. Preferably, n sensors are used, with one sensor for each flute of the chute. Also, where the parts sorter is used for counting tablets or capsules or the like, preferably, the sorter includes an exit gate array for directing the tablets or capsules to their appropriate destinations.

In accord with a further aspect of the invention, the parts sorter is adjustable for handling parts of different dimensions. In order to make the sorter adjustable, the channel width is adjustable, the fluted chute has diverging flutes, and the relationship between the channel and the fluted chute is arranged such that the width of the end of the channel and the width of the portion of the fluted chute which first receives the parts are substantially equal. Preferably, in providing such an arrangement, the fluted chute is provided with adjustable fingers defining the flutes. Alternatively, the flutes are fixed (non-adjustable) and the channel can be lengthened or shortened so that the end of the channel is located where the width of the diverging fluted chute is equal to the channel width. If automatic adjustment is desired, the optical sensors should preferably be sensitive to the dimensions of the parts. Then with feedback from the sensor to a servo system, the fingers of the chute or the channel floor may be automatically adjusted by the servo system.

Other preferred aspects of the invention include: use of a vibrating platen as a means of forward translation; provision of adjustable width walls or fences to define the channel; use of an adjustable venturi or throttle to help reduce the three dimensional parts arrangement in the bin into a two dimensional parts arrangement on the vibrating platen; a microprocessor for automatic control of the channel width and finger arrangement as well as for permitting a simplified interface for human input; gate control to permit a plurality of containers to be filled simultaneously or in a programmed sequence; a return tray for capturing parts which remain in the system after additional filling of containers is not desired; and a controller for varying the amplitude and/or frequency of the platen vibration to accommodate different speeds and different size parts. The various aspects of the invention all permit the parts sorter to have all of the desired features aforestated in the Background section herein.

Other objects, features, and advantages of the invention will become apparent to those skilled in the art upon reference to the following detailed description of the invention and the accompanying drawings.

BRIEF DESCRIPTION OF THE DRAWINGS

FIGS. 4*a* and 4*b* are flow diagrams of the control algorithm for the microprocessor of the sorter invention.

DETAILED DESCRIPTION OF THE PREFERRED EMBODIMENT

Figure 1A:
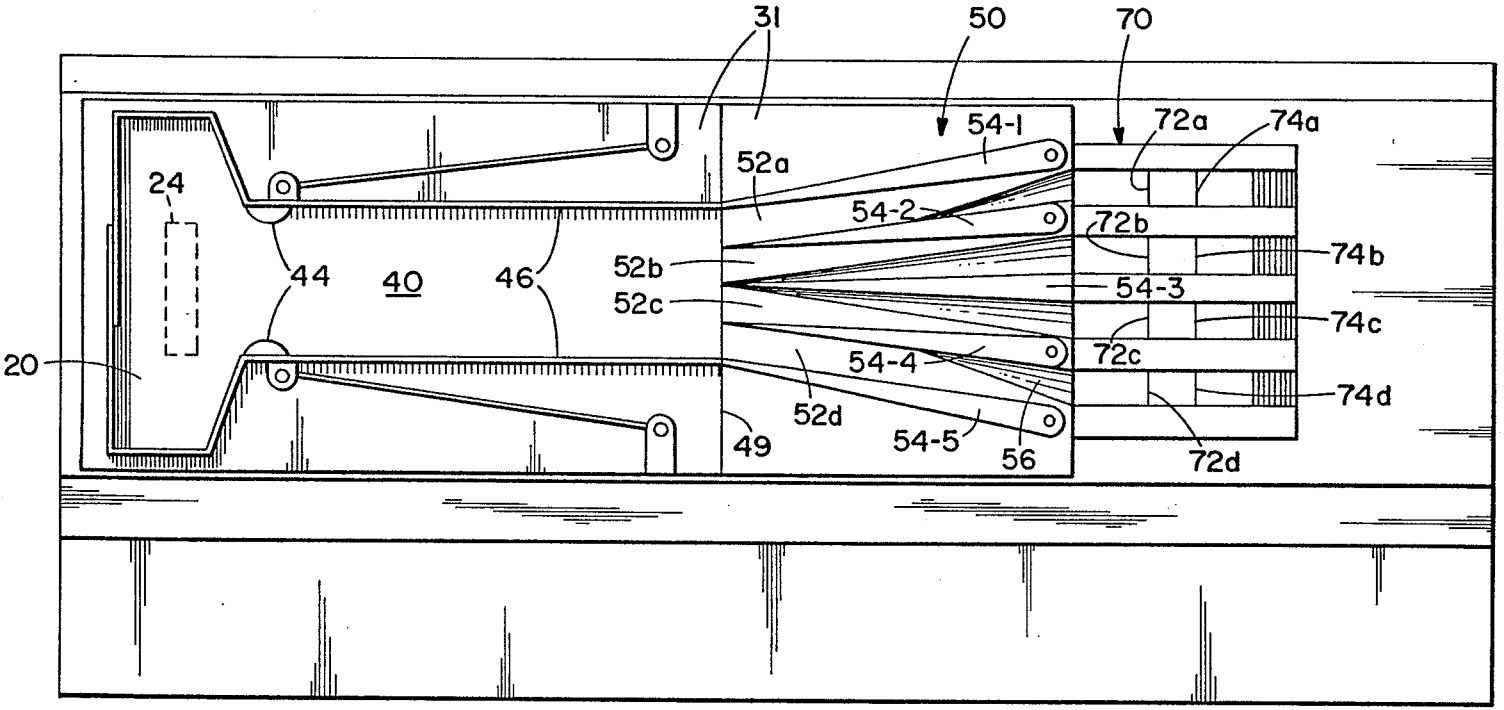
FIG. 1*a* is a top plan view of the invention.
Figure 1B:
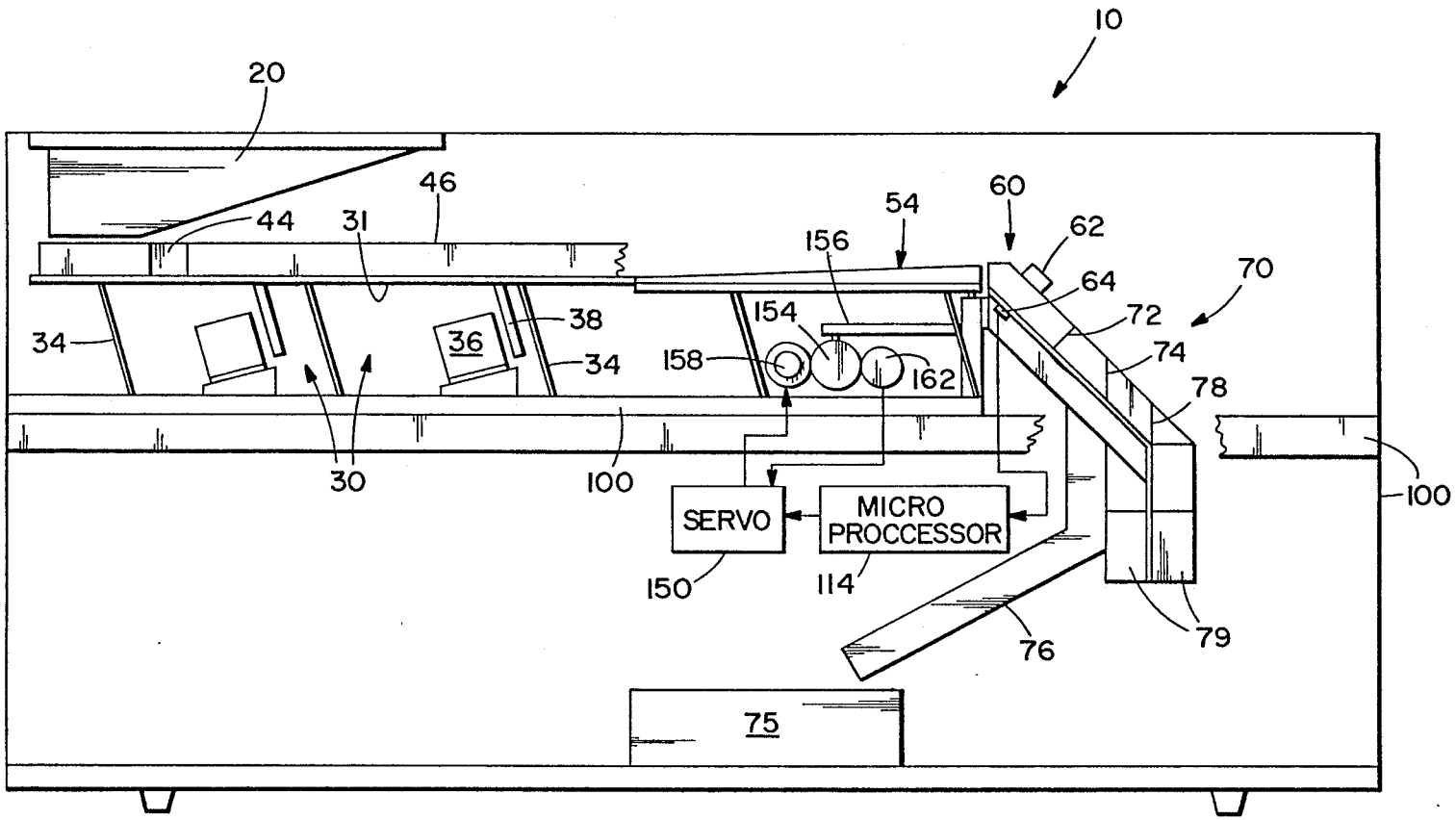
FIG. 1*b* is a side plan view, partially in section, of the invention.

The essence of sorting and/or counting parts is to take a plurality of parts which are in a three-dimensional arrangement, and reduce the three-dimensional arrangement into a one-dimensional arrangement such that each part may be handled separately. The preferred embodiment of the invention for accomplishing this task is seen generally in FIGS. 1*a* and 1*b* and 2. The parts sorter apparatus 10 basically includes a holding bin 20, a means of forward translation 30 for the parts, a channel 40, and a fluted chute 50. The holding bin 20, as is best seen in FIG. 1*b*, provides a volume (three-dimensional) for accepting a plurality of parts. The bin is preferably supported by the chassis 100 of the apparatus 10 so that the weight of the bin and the parts do not apply an excessive force to the forwarding means 30. Indeed, the only force applied is by the parts which are directly above an opening 24 which is provided at the bottom of the bin 20. The size of the opening and the clearance of the bin opening 24 over the forwarding means 30 are chosen in a manner to accommodate the range of sizes of the parts and the throughput of the apparatus. Indeed, if desired, both the opening 24 and the clearance may be adjustable. It is of note, however, that it is not critical immediately upon leaving the bin that the parts establish a two-dimensional arrangement. This is so because the forwarding means 30 and the channel 40 are preferably arranged to enable parts to establish such a two-dimensional arrangement.

Figure 5:
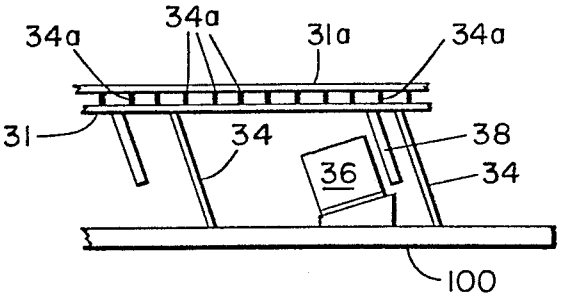
FIG. 5 is a side plane view of the double spring-mass system of the invention.

Directly below the bin 20 is the entry to the channel 40 which will be described in greater detail hereinafter. Parts are advanced along the channel 40 by the means of forward translation 30. While many different means of forward translation (hereinafter "forwarding means") are known in the art, the forwarding means 30 herein is preferably a vibrating platen assembly. The vibrating platen assembly is preferably comprised of a spring-mass system with an upper plate (or vibrating platen 31 on which the channel 40 is formed) as the mass, and cantilever spring supports 34 as the springs. The spring supports 34 are arranged to connect the upper plate of the spring-mass system to the chassis 100 but are flexible enough to allow the upper plate 31 to move in a vibratory manner relative to the chassis. In order to vibrate the upper plate, an electromagnetic shaker is used such as is manufactured under #CV-1 by General Automation of San Diego, California. The shaker preferably includes the magnetic coil 36 which is attached to the chassis, and a magnetic armature 38 which is attached to the upper plate 31. The magnetic coil 36 is arranged to have current flowing therethrough to alternately attract and release the armature 38, thereby causing the armature 38 and platen 31 which is attached thereto to vibrate. Those skilled in the art will recognize that the speed and amplitude of vibration are thereby controllable. It will also be recognized that the vibrating platen may be arrranged such that parts which are to be sorted will be driven to uniformly have one axis (the preferred axis) in a given direction thereby providing a characteristic dimension of width x, perpendicular to the direction of travel. Further, and as seen in FIG. 5, it should be appreciated that second and further order spring-mass systems may be stacked atop the vibrating platen 31 if desired by locating a compliant (rubber) strip 34*a* atop the vibrating platen 31, and attaching another plate 31*a* thereto which will act as the surface for the channel.

While the forwarding means 30 is helpful in eliminating parts from sitting atop each other, the channel 40 is also arranged to do the same. Thus, the channel is preferably comprised of a low friction surface (shown as 31) which is either identical to or integral with the top plate 31 of the vibrating platen assembly, a venturi or throttle 44 for restricting flow, and sides or fences 46 for establishing a channel width. When parts descend through the bin opening 24 onto the channel surface 31, they are vibrated along the channel by the forwarding means 30. However, the venturi 44 restricts the flow thereby limiting the number of parts which may proceed over a measured period of time. Once the parts proceed through the venturi, they typically establish a two-dimensional arrangement due to gravity. The vibrating action tends to aid the process of reducing the parts into the minimum energy two-dimensional configuration.

The channel is preferably arranged with fences 46 which define a channel width of $nx+e$, (e being a width greater than or equal to zero, and less than x) where n is an integer determined by the number of flutes in the fluted chute 50 and x is the characteristic dimension of the parts which are to be sorted. Thus, the parts tend to proceed n abreast within the channel towards the fluted chute 50 with their axis of the characteristic dimension perpendicular to their direction of movement. Because the channel width is only slightly larger than nx (i.e. not as large as $(n+1)x$), there is no opportunity for a row of more than n parts to arrive at the end of the channel simultaneously. Also, because of the venturi arrangement and the vibrating platen provide a two-dimensional arrangement of parts, it is unlikely that more than n parts would attempt to settle into the n slots available. It will be appreciated that the size of the venturi may be controlled as desired. Also, as will be discussed hereinafter with regard to another aspect of the invention, the width of the channel may be automatically controlled.

At the end of channel 40, the parts reach a fluted chute 50. For purposes herein, the "chute" 50 shall be defined to be that area which receives the parts from the channel 40, divides the parts into one-dimensional lines of parts, and then forwards the parts for handling as desired. The "flutes" 52 shall be defined to be the individual channels in the chute 50 through which the lines of parts traverse. The "fingers" 54 shall be defined to be the objects which separate the flutes 52 one from another. It will be recognized that the fingers 54 can be of minimal thickness. As seen best in FIG. 1*a*, the fluted chute is preferably comprised of n flutes 52*a*, 52*b* . . . each having a width where they meet the channel 40 of approximately x (but not smaller than x). The flutes are preferably separated and defined by $n+1$ fingers 54-1, 54-2 . . . , which effect the dividing of the leading row of n parts exiting the channel into n separate streams. Preferably, the flutes 52 diverge and widen as they proceed away from the channel 40. The angling of the flutes generally helps keep the parts in a single line. Also, the flutes 52 preferably slope downward as they proceed away from the channel 40 to promote separation of the parts. If desired, the flutes 52 may include a rounded scalloped area 56 to further guide the parts as they proceed towards the end of the chute 50. The fingers 54 which also act to guide the parts down the fluted chute preferably have a minimal thickness where they meet the channel 40. Thus, the width of the fluted chute where it meets the channel 40 is just slightly greater than nx, with the sum of the widths of the flutes comprising a width of nx. As will be described hereinafter with reference to another aspect of the invention, the fingers 54 are preferably controllable such that the width of the flutes 52 may be changed automatically to accommodate a change in parts.

Where the parts sorter is a counter, such as for tablets or capsules, the sorter 10 preferably further includes a sensor for counting the parts exiting each flute 52 of the fluted chute 50. In the preferred embodiment, the counter is an optical counter and the sensor is an optical sensor 60. Preferably, n sensors 60 are used, with one sensor for each flute of the chute. The sensor 60 typically comprises an infrared source 62 and a photodiode 64 (or photovoltaic or photoresistor or other). As a part such as a tablet or capsule interrupts the infrared beam generated by the infrared source 62, the photodiode 64 senses the interruption (shadow) and updates a counter. As will be described in more detail hereinafter with regard to the automatic control of the apparatus 10, the detector 64 may also be arranged to detect the size of the part interrupting the infrared beam by measuring the size and time of the shadow.

Also, where the parts sorter apparatus 10 is used for counting tablets or capsules or the like, preferably, the sorter 10 includes an exit gate array 70 for directing the tablets or capsules towards appropriate location. The gate array may comprise various gates for sorting the tablets or capsules as desired. One preferred arrangement provides an accumulator gate 72 which accumulates the tablets or capsules so that a certain number may all be released simultaneously to a container or bottle arranged at an exit manifold 79. A second gate may be a return gate 74 which permits the tablets or capsules remaining in the system to be captured and returned to a return bin 75 via a return manifold 76 after additional filling of containers is not desired. Finally, a diverter gate 78 may be provided so that the capsules or tablets may be directed to a desired exit manifold leading to the bottles. In this manner, more than one bottle may be simultaneously or sequentially filled with tablets or capsules. For simultaneous filling, all that is required is that the tablets or capsules be properly controlled to direct them to different desired locations such as by having tablets exiting different flutes be diverted to different exit manifolds 79. For sequential filling, all diverter gates 78 may be arranged to first send the tablets to a first manifold and then to toggle simultaneously to divert the tablets to a second manifold. Those skilled in the art will appreciate that other gates may be supplied as desired to provide additional functions. Likewise, with additional diverter gates 78 and exit manifolds 79, the simultaneous filling of additional bottles or containers may be established. Indeed, if desired, the bottles or containers can be on a movable belt for increased automation.

In accord with a further aspect of the invention, the parts sorter apparatus 10 is adjustable for handling parts of different dimensions. In order to make the sorter adjustable, the channel 40 is arranged to have an adjustable width by having fences 46 be movable. Thus, as the characteristic dimension x of the parts changes, the width nx of the channel may change. However, solely a change in the channel width will not fully accommodate a change in the parts to be sorted. Because the relationship between the channel 40 and the fluted chute 50 is such that the width of the end of the channel and width of the portion of the fluted chute which first receives the parts are substantially equal, if the channel width is changed, the width of the receiving portion of the fluted chute must change. Preferably, in order to provide a fluted chute 50 with an adjustable width receiving section, the fluted chute 50 is provided with adjustable fingers 54 which define and divide the flutes 52. It will be appreciated that with moving fingers 54, the fingers other than the center finger (which need not be movable) will not always have their tips exactly abutting the edge of the channel. In order to accommodate the arc length change which results from the rotation of the fingers, either a small gap must be allowed between the end of the channel 40 and the defined flutes 52 in some circumstances, and/or the fingers must be allowed to extend beyond the edge of the channel 40. Thus, in the preferred embodiment of the invention, the fingers 54 extend under the channel 40, thus providing a small ledge 49 at the end of the channel 40. In this manner, the fingers 54 may be moved closer together or further apart to accommodate the channel width. Also, in this manner, the tips of the fingers are advantageously concealed from the tablets or capsules. Preferably, the end of the fingers 54 furthest from the bin 20 are stationary, and the tips of the fingers are moved by rotating the fingers about the stationary end.

Figure 2:
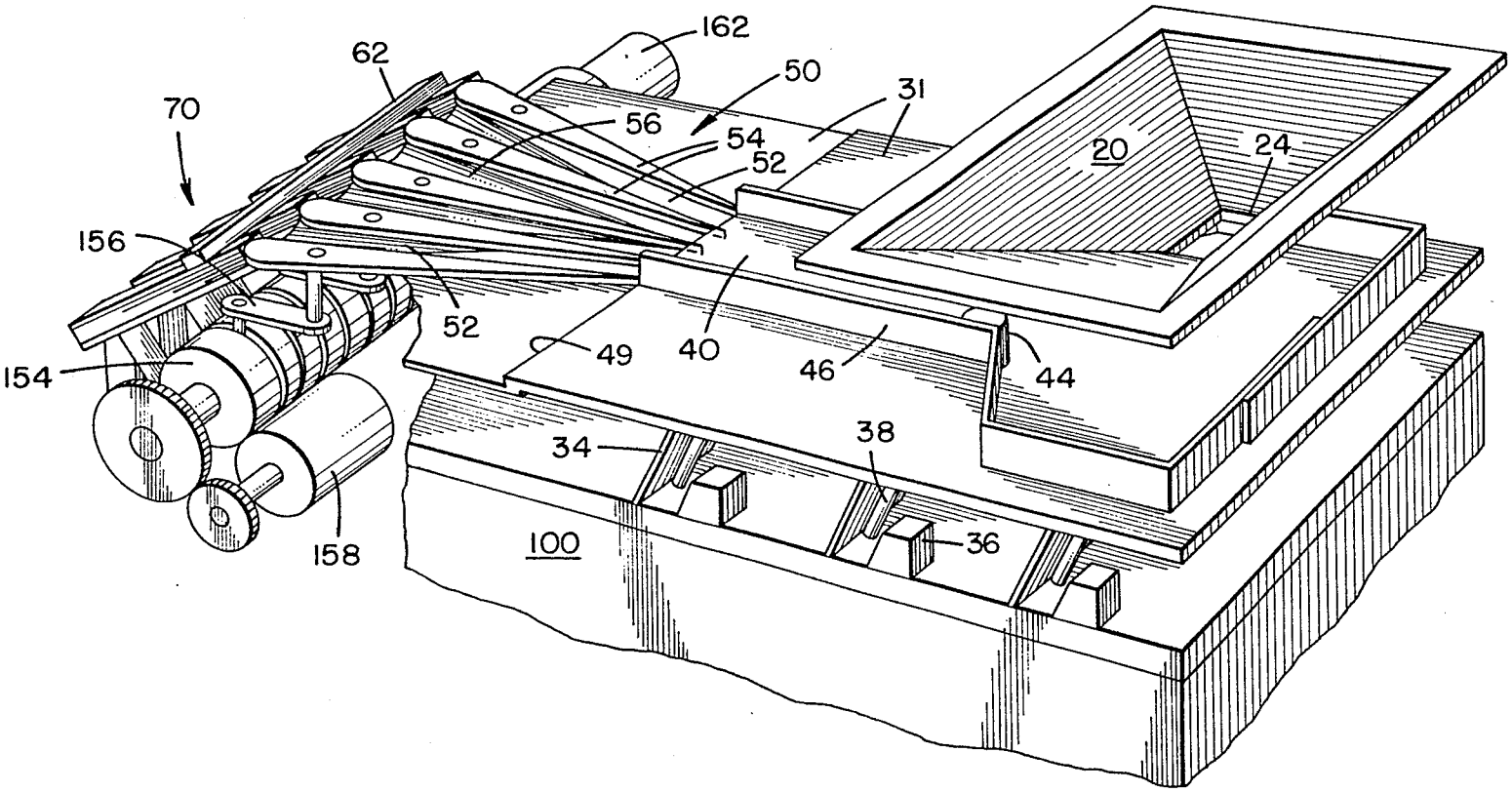
FIG. 2 is a partially cut-away perspective view of the parts sorter invention.

It will be appreciated that the outer fingers (e.g. 54-1 and 54-5) of the fluted chute 50 will extend the furthest under the channel 40, as a change in the smaller dimension of the parts will cause the outer fingers to be rotated the most. In fact, if the dimensions of the part decreases by length d, and the outer fingers are two fingers away from the middle finger, the tips of the outer fingers must be moved in by a distance 2d. However, even though the thickness of the fingers may increase in the direction away from the bin 20, the outside fingers do not add additional thickness to the nx thickness, as the thickness of the fingers may be arranged to be on the outside of the nx width, as shown in FIG. 1*a*. It will also be appreciated, as seen in FIG. 2, that the outside fingers may be directly connected to the channel fences 44. Thus, the movement of the chute fingers will automatically move the channel fences 44 and keep the widths equal.

Another manner of guaranteeing that the width of channel 40 is equal to the width of the fluted chute 50 where the two meet, is to extend the channel 40 over the a set of geometrically fixed diverging flutes until the same is accomplished. While such an arrangement may not be preferred due to the complexity of providing such a channel extension as well as the possibility that the channel would extend over a good portion of the flutes (or the necessitated extra length of the apparatus), those skilled in the art will recognize that such an arrangement does provide a solution because at some point (where the flute walls or fingers have a neglible but constant thickness), the width of each flute would equal the characteristic dimension width of the part.

Figure 3:
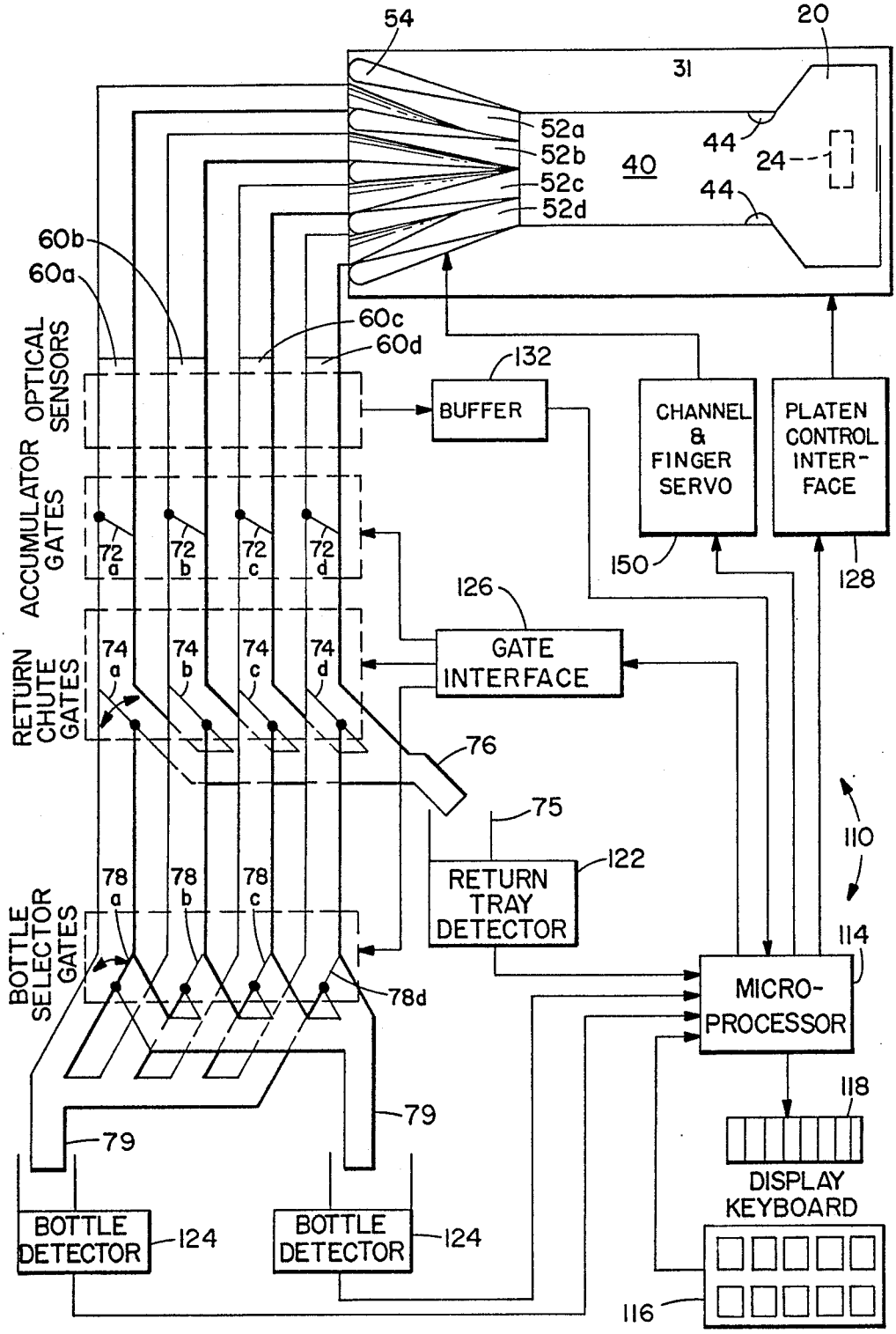
FIG. 3 is a part schematic part block diagram of the control system of the invention.

Turning to FIG. 3, it is seen that the apparatus invention preferably includes control means 110 for controlling various mechanical aspects of the apparatus. The control means includes a microprocessor 114 such as an Intel 8031 which preferably has a RAM, EPROM, address latch, data bus, and bidirectional bus driver (all not shown) associated therewith. The EPROM is provided to hold a desired program (which will be described with reference to FIG. 4) and the address decoders which permits the microprocessor to interface with peripherals. Thus, the microprocessor is arranged to interface with a user via a keyboard input means 116. The microprocessor also interfaces with a display 118, such as an alphanumeric LED array, for displaying information to the user. In conjunction with the commands of the user, and information received from return tray detector 122, bottle detectors 124, and other described logical conditions if provided, the microprocessor is seen to control the mechanical gates 72, 74 and 78 via the gate interface 126. Likewise, in conjunction with the commands of the user, the microprocessor 114 can control the amplitude and frequency of the platen vibrations via platen control interface 128. Also, in conjunction with the commands of the user or as a result of information received from optical sensors 60 via a buffer 132, the microprocessor can actively control the width of the channel 40 and the movement of the fingers of the fluted chute 50 via commands to a servo-controller 150.

In order to provide for automatic adjustment of the apparatus to accommodate a change in the parts dimensions, either the user must inform the microprocessor 114 of the information by feeding the new dimension to the microprocessor via keyboard 116, or additional means must be provided to sense the characteristic dimension of the parts. In accord with the preferred embodiment of the invention, an array of photodiodes with associated logic and circuitry are arranged to provide exactly that function. Thus, each sensor 60 not only includes an infrared source 62, but, for example, an array of sixteen integrated circuit chips which have a photodiode thereon. Chips such as the TRW OPC812 can be used for such purposes. With such an arrangement, a determination of the characteristic dimension of the part may be had by sending the results to the microprocessor 114 and then averaging the results over a desired number of samples. Of course, refinement and active adjustment may be continually had.

With a determination of the characteristic dimension of the parts to be sorted, the microprocessor 114 can send directions to a servo-controller 150. The servo-controller 150 may then provide signals for automatically adjusting the widths of the flutes 52 of the fluted chute 50 and the width of the channel 40 by the movement of the fingers 54. In order to adjust the widths of the flutes 52 and the channel 40, a servo-controller system preferably comprises the servo-controller 150, a control cam 154, lever arms 156 which follow the tracks in the control cam and which rotate the fingers of the fluted chute accordingly, a motor 158 for turning the control cam 154, and a potentiometer 162 for determining the position of the control cam. Thus, as seen in schematic form in FIG. 1*b*, in cut-away perspective form in FIG. 2, in block form in FIG. 3, the instructions of the microprocessor 114 are interpreted by the servo-controller 150 which causes a voltage to be seen by the motor 158. In response the motor drives the control cam 154 by rotating it in the desired direction. The control cam 154 is preferably arranged with tracks which are slightly inclined relative to the rotational axis of the cam to form a cylidrical spriral, with the inclination or pitch of the tracks for the outer arms being proportionately larger than those of the inner arms. As the control cam 154 rotates, the lever arms 156 follow the tracks or grooves and force the fingers 54 of the fluted chute 50 to rotate accordingly. A potentiometer 162 monitors the rotation of the control cam 154 and provides a feedback signal to the servo-controller 150 so that the voltage to the motor 150 can be correspondingly changed. Again, as aforementioned, because the channel fences 46 are preferably attached to the outer fingers 54, the rotation of the control cam 154 causes the channel width to change along with the movement of the outer fingers.

A representative operation of the sorting apparatus 10 is best understood with reference to FIGS. 4*a* and 4*b* which set forth in flow diagram format the algorithm of a control program contained in the EPROM of the microprocessor. For purposes of understanding, the program of the EPROM of the microprocessor of the apparatus 10 will be described with reference to a tablet or capsule counter.

Upon powering up of the apparatus at 200 by plugging into a standard outlet and toggling a switch, the default parameters of the apparatus 10 are initialized at 202. The apparatus is then ready to accept set up information from the user and checks at 204 to see whether any buttons on the keyboard 116 have been pressed. If no buttons have been pressed, the apparatus waits at 206 until the user enters information.

The keyboard 116 preferably comprises three sets of buttons; a numeric pad; a set up control set; and an operation control set. The numerical pad includes the standard ten numerals which permit the user in the set up mode to choose the number of tablets or capsules to be packaged into an individual bottle, and the number of individual bottles to be filled. The set up control buttons permit the user to clear the display if an incorrect number of bottles or tablets have been chosen, and if desired, to roughly prearrange the apparatus for tablets or capsules of different sizes. The operation control buttons permits the user to start and stop the operation of the apparatus, and to place the apparatus in a pause mode where the programmed parameters are retained but the apparatus is not actively processing tablets.

Once the keyboard has been pressed, a decision is made at 208 as to whether a set up mode button (including numeric) or an operation control button has been pressed. If a set up mode button has been pressed, a decision is made at 210 as to whether the button is a number or not. If it is a number, a decision is made at 212 as to whether the bottle number button has been pressed or not prior to the number. If the bottle amount button has not been pressed, the number being entered is for the tablet quantity. The number is displayed on the display 118, and the tablet quantity is then stored at 214 in memory. The apparatus then awaits the pressing of another button at 204. If, on the other hand, the bottle amount button had been pressed, the number being entered is considered to indicate the number (or amount) of bottles to be filled. That number is also displayed on the display 118 with a light next to the bottle amount button, and the number is stored at 216 in memory.

If the set up button pressed at 208 was not a number, it is assumed to be a set up control. Thus, at 222 a decision is made as to whether the control button was a bottle amount, a capsule choice, a size choice, or a clear display command. If the button was a bottle amount, the program continues at 224 and waits for additional information at 204. If a capsule choice is made (default = tablet), the information is stored in memory at 226 and the program returns to await the pressing of another button at 204. If a tablet or capsule size button is pushed (small, medium, or large), the size is recorded in memory at 228 and the program likewise returns to 204. On the other hand, if the clear button is pressed, the display is cleared (a "0" appears) at 230, and a decision is made at 232 as to whether the bottle amount button has been pressed. If the bottle amount was pressed, the memory for the bottle amount is reset at 234. Otherwise, the quantity of tablets or capsules is reset at 236. The program then returns to 204 to await additional instructions.

If the button pressed at 204 is found at 208 to be an operation control, a decision is made at 240 as to whether the operation control is the start control. If it is, a determination is made at 242 as to whether the tablet or capsule quantity has been set, and whether a size has been chosen. If one or the other has not been accomplished, an appropriate error message is sent at 246 to the display, and the program is returned to 204. If everything is in order, the system waits at 244 while the microprocessor 114 instructs the servo system 150 to arrange the channel 40 and fluted chute 50 to accommodate the proper size tablet or capsule. The microprocessor may also set the frequency of platen oscillation based on the stated rough size of the tablet or capsule, open the accumulators, and close the return chute before the sorting and counting operation commences. Once the operation commences, the keyboard is constantly monitored for additional instructions.

If the control button pressed at 204 is not a start button, a determination is made at 248 as to whether the cancel (stop) button has been pressed. When the stop button has been pressed, if operation of the system has commenced, it is stopped. Regardless, the entire programming is started anew as the program returns to the initialization step 202. If the stop button was not pressed at 248, it is assumed at 252 that the pause command has been issued. Thus, the microprocessor brings the platen vibration to a halt and awaits at 204 another command such as "start" or "cancel". If desired, other commands such as "jog" may be provided to permit a manual control of the operation of the system.

Turning to FIG. 4*b*, the flow chart of the EPROM program which controls the apparatus once the start button has been pressed and the servo system has been preliminarily set. At 260, information from an optical sensor 60 is read via a buffer 132, and a determination is made at 262 whether an object is being sensed. If a tablet is being sensed a no-sensing (empty) timer is reset to zero at 264. Then, at 266 a decision is made as to whether the tablet being sensed is a new tablet; i.e. the previous time through the loop, was no object sensed? If the tablet is not a new tablet, a running tabulation is made at 268 of the tablet's size through a knowledge of the amount of light being received and the length of time it is taking for the tablet to pass the sensor. If the tablet is a new tablet, a determination is made at 270 as to whether the tablet is being accumulated by the accumulator or is being permitted to go to a bottle. If the tablet can go to the bottle, a quantity index for the bottle is incremented at 271. Then the tablet's size is integrated as aforestated at 268. If the tablet is being accumulated, a counter keeps track at 272 of the number of tablets at the accumulator and then the size is integrated at 268.

If no tablet is sensed at 262, a determination is made at 276 whether any object has been seen over a period of time T. If a period of time T has elapsed without a tablet being sensed, a determination is made at 278 as to whether the the tasks have been accomplished. If yes, the program is returned to the initialize step 202. If the task has not been accomplished, it is assumed that the apparatus is empty and an empty signal is flashed at 279 on the display 118. Then the program is returned to step 204 where user input is desired.

If no tablet is seen, but the time T has not elapsed, a determination is made at step 280 as to whether the appearance of no tablet is indicative of the end of the tablet, i.e. is it the first run through the code after the tablet is no longer sensed. If the tablet has immediately passed the sensor, a determination is made at 282 as to whether the tablet was one of a predetermined number of first tablets through the system. If it was, the size of the tablet is added at 283 to a running average which is used to fine tune the channel width and chute fingers via the servo mechanism. If the tablet was not one of the first number of tablets through, the size of the tablet may be compared at 284 to twice (or multiple greater than one) the predetermined running average and if it exceeds the multiplier times the average, an extra tablet(s) may counted by returning the program to step 270.

Once each sensor has been checked for tablets exiting the flute of the chute with which it is associated and the program has looped through steps 260 and 284 for each sensor, the program continues by checking to see whether the bottles have been filled and whether the order has been filled. Thus at 290, a determination is made as to whether any more tablets are expected at the accumulator or diverter gate, by ascertaining whether a tablet is being sensed at the sensor. If no tablets are coming, the program returns to step 260 to check the sensors. If tablets are expected, a determination is made at 292 as to whether the tablet is to be the last tablet for the bottle. If it is, a timing mechanism is started at 294 for the diverter gate, as it takes some time from the moment the last tablet is sensed until it reaches the diverter and the diverter should not be toggled until that occurrence. Once a present time has passed, as determined at 297, a determination is made at 298 as to whether the last bottle of the order is being filled. If not, at 302 the diverter gate is toggled, the bottle amount (count) is incremented and the accumulator is opened (if closed). The program then returns to step 260 to check the sensors. If the last bottle is being filled, at 304 the return chute is opened, the servo mechanism opens the channel to its maximum size and the program returns to step 260 until all the tablets are returned to the return tray and the sensors do not sense tablets for the predetermined amount of time.

If a decision is made at 292 that the tablet was not the last tablet for the bottle, a determination is made at 306 whether the tablet would exceed the number for the bottle. If yes, the accumulator is closed at 296 thus blocking the flow of additional tablets to his bottle and the program continues as aforedescribed. If the tablet is not the last and would not exceed the number for the bottle, the program continues at step 260.

It should be appreciated that the microprocessor of the invention is preferably able to step through the flow chart of FIGS. 4*a* and 4*b* at least on the order of the second power of ten repetitions each second. Such a speed permits an accurate determination of the size of the tablets being processed and quickly enables the servo mechanism to adjust chute finger locations and the size of the channel. It should also be appreciated that many other desirable features may be provided with the microprocessor and associated circuitry as so described. For example, the microprocessor could check to see that the return tray is in place prior to permitting the apparatus to fill an order. Likewise, the toggling of the accumulator may be timed in much the same manner as the timing of the diverter gate, as it takes some time for a last tablet for a bottle to travel from the sensor past the accumulator gate. Of course, the timing must be coordinated with the fact that with mechanical gates, there is a finite time to accomplish opening and closing. Further, sensors to determine bottle size can be implemented and the microprocessor could issue commands to adjust the bottle sizes in response thereto. Also, detection of foreign objects may be accomplished by comparing the sensed object size to a continuous running average, and warning of foreign objects may be given to the user.

There has been described and illustrated an apparatus for sorting a plurality of substantially identical parts, and especially a tablet or capsule counter. While particular embodiments of the invention have been described, it is not intended that the invention be limited thereby, as it is intended that the invention be broad in scope and that the specifications be read likewise. Thus, it will be understood by those skilled in the art that while a particular means for forward translation (vibrator) was described, many different such means are known in the art. For example, the means for forward translation could comprise means for tilting the channel such that gravity will act as a forwarding force. Or, if desired, a moving belt, air jet, or other means or combination of means could be used for forwarding the objects and still be within the scope of the invention, as the terminology "means for forward translation" is intended to be extremely broad in scope.

Further, it will be understood that the number and shape of the fingers and flutes of the fluted chute can be changed without deviating from the invention, provided that the row of n parts exiting the channel is separated by the fluted chute into n one dimensional lines of parts. For example, the flutes could decline away from the channel such that gravity rather than the vibrating platen which extends through the chute area would cause the objects to proceed. Likewise, the bin, channel, servo mechanism, sensor and gate arrangement, and microprocessor programming and control could all be substantially changed. The bin opening need not be on the bottom of the bin. Indeed, the bin itself need not be a conventional bin, but rather a source for the parts to be sorted. The channel, while preferably having parallel walls, could have slightly diverging walls and/or no venturi. Also, the channel width which was described as being controlled by the servo control system by having the outer fingers attached to the channel fences, may be controlled by separate means with the fences not being attached to the outer fingers. The servo mechanism could utilize gears or the like rather than a control cam and lever arms. The sensor for a parts counter need not be optical. Different gating arrangements could be provided to perform fewer or more desired functions. The microprocessor and related circuitry could subsume the functions of the servo-controller by generating voltages for the motor operating the control cam. Or, if desired, some of the microprocessor functions can be subsumed in the servo-controller and if desired, a computer can be appended to the system. Thus, the determination of part widths for controlling the adjustability of the system could be accomplished in the servo or in an appended computer. Moreover, the program controlling the microprocessor and various aspects of the apparatus invention could take numerous forms. Therefore, it will be apparent to those skilled in the art that other changes and modifications may be made to the invention as described without departing from the spirit and scope of the invention as so claimed.

It should also be understood that, if desired, the channel width can be made smaller than nx, (i.e. nx-e where e is a width), even where the fluted chute has n flutes. In this arrangement, the throughput of the apparatus would necessarily decrease below its maximum attainable value.

We claim:

1. An apparatus for sorting a plurality of substantially identical parts, comprising:

(a) a source of parts for said apparatus;

(b) a means of forward translation for forwarding said parts;

(c) a channel having a width of approximately nx, where n is an integer greater than one and x is the width of a characteristic dimension of said parts based on a preferred orientation of said parts due to translation, where said channel accepts a plurality of parts from said source of parts, and together with said means for forward translation arranges the parts into a substantially two dimensional plane of parts of no more than n abreast in said channel and forwards the parts towards a chute;

(d) a fluted chute having n flutes each of a width of at least x, each flute diverging one from another as they extend from said channel, said fluted chute for dividing said substantially two dimensional plane of parts into n one dimensional lines of parts, such that said parts may be individually handled;

(e) means for adjusting the width of said channel to accommodate a change in the width x of said characteristic dimension of said parts;

(f) means for adjusting the widths of said flutes where said fluted chute accepts said parts from said channel; and (g) means for sensing the width of said parts and outputting a signal representative thereof, wherein said means for adjusting the width of said channel includes means for automatically adjusting the width of said channel in response to a signal related to said signal output by said means for sensing, and said fluted chute includes finger means for defining said flutes, and said finger means is adjustable.

2. An apparatus according to claim 1, wherein:

said means for adjusting the widths of said flutes includes means for automatically adjusting the locations of said fingers of said chute in response to a signal related to said signal output by said means for sensing.

3. An apparatus according to claim 1, wherein:

said means for automatically adjusting the width of said flutes where said chute accepts said parts from said channel comprises a servo control system including a servo-controller for receiving signals related to said signal output by said means for sensing and for outputting signals related to said received signals, and a motor responsive to the signals output by the servo-controller, wherein the motor causes said fingers to be adjusted.

4. An apparatus according to claim 1, wherein:

said means for forward translation comprises a vibrating platen.

5. An apparatus according to claim 4, wherein:

said source of parts is a holding bin having a volume for holding a plurality of substantially identical parts and an opening for releasing some of said parts to said channel, and said channel includes an entry area for receiving said parts from said hoding bin, a throttle, and an area having parallel fences.

6. An apparatus according to claim 4, wherein:

said means for forwarding translation further comprises at least one additional spring-mass system stacked atop said vibrating platen.

7. An apparatus according to claim 6, wherein:

each said additional spring-mass system comprises a compliant strip and a plate atop said compliant strip.

8. An apparatus according to claim 1, wherein:

each of said flutes has a substantially rounded bottom surface along at least part of its length, and each flute descends as it extends away from said channel.

9. An apparatus for counting a plurality of substantially identical parts, comprising:

(a) a holding bin having a volume for holding a plurality of substantially identical parts and an opening for releasing some of said parts;

(b) a means of forward translation for forwarding said parts;

(c) a channel having a width of approximately nx, where n is an integer of said parts based on a preferred orientation of said parts due to translation, where said channel accepts a plurality of parts from said opening in said holding bin, and together with said means for forward translation arranges the parts into a substantially two dimensional plane of parts of no more than n abreast in said channel and forwards the parts towards a chute;

(d) a fluted chute having n flutes each of a width of at least x, said flutes diverging one from another as they extend away from said channel, said fluted chute for dividing said substantially two dimensional plane of parts into n one dimensional lines of parts, such that said parts may be individually handled;

(e) a means for counting said parts after said parts have been divided into n one dimensional lines;

(f) means for adjusting the width of said channel to accommodate a change in the width x of said characteristic dimension of said parts;

(g) means for adjusting the widths of said flutes where said fluted chute accepts said parts from said channel; and (h) means for sensing the width of said parts and outputting a signal representative thereof, wherein said means for adjusting the width of said channel includes means for automatically adjusting the width of said channel in response to a signal related to said signal output by said means for sensing, and said fluted chute includes finger means for defining said flutes, and said finger means is adjustable.

10. An apparatus according to claim 9, wherein:

said means for counting said parts includes an optical sensor.

11. An apparatus according to claim 10, further comprising:

(f) a gate section for receiving said parts and directing said parts to a desired location after said parts have been counted by said optical sensor.

12. An apparatus according to claim 11, wherein:

said gate section includes at least n accumulator gates for accumulating parts prior to direction and at least n deflector gates for deflecting said parts towards a desired location when said accumulator gates are not accumulating said parts.

13. An apparatus according to claim 12, further comprising:

(g) means for controlling said gate section; wherein said optical sensor outputs information to said means for controlling said gate section;

said means for controlling said gate section toggles at least one accumulator gate after the last part for a given destination passes said accumulator gate; and said means for controlling said gate section toggles at least one diverter gate after said last part for a given destination passes said diverter gate.

14. An apparatus according to claim 11, further for sorting said plurality of parts into a plurality of containers, further comprising:

(g) a return tray for capturing parts in said apparatus having a destination other than said containers, wherein, said gate section further includes a return gate for directing said parts having a destination other than said containers to said return tray.

15. An apparatus according to claim 14, wherein:

said channel includes an entry area for receiving said parts from said holding bin, a throttle, and an area having parallel fences.

16. An apparatus according to claim 9, wherein: said means for adjusting the widths of said flutes includes means for automatically adjusting the locations of said fingers of said chute in response to a signal related to said signal output by said means for sensing.

17. An apparatus according to claim 9, wherein:

said means for automatically adjusting the width of said flutes where said chute accepts said parts from said channel comprises a servo control system including a servo-controller for receiving signals related to said signal output by said means for sensing and for providing signals related to said received signals, and a motor responsive to the signals output by the servo-controller, wherein the motor causes said fingers to be adjusted.

18. An apparatus according to claim 9, further comprising:

(i) a microprocessor for receiving signals from at least said means for sensing, for processing signal information, and for providing signals for at least said servo-controller.

19. An apparatus according to claim 9, wherein:

said means for forward translation comprises a vibrating platen.

20. An apparatus according to claim 19, wherein:

said means for forwarding translation further comprises at least one additional spring-mass system stacked atop said vibrating platen.

21. An apparatus according to claim 20, wherein:

each said additional spring-mass system comprises a compliant strip and a plate atop said compliant strip.

22. An apparatus according to claim 9, wherein:

each of said flutes has a substantially rounded bottom surface along at least part of its length, and each flute descends as it extends away from said channel.

* * * * *